US011117170B2

(12) United States Patent
Gao et al.

(10) Patent No.: US 11,117,170 B2
(45) Date of Patent: Sep. 14, 2021

(54) SYSTEM AND METHOD FOR DETECTING METAL STAMPING PART TAPPING DEFECTS

(71) Applicant: SHENZHEN UNIVERSITY, Guangdong (CN)

(72) Inventors: Zhijian Gao, Guangdong (CN); Ting Wang, Guangdong (CN); Qinghao Zeng, Guangdong (CN)

(73) Assignee: SHENZHEN UNIVERSITY, Shenzhen (CN)

( * ) Notice: Subject to any disclaimer, the term of this patent is extended or adjusted under 35 U.S.C. 154(b) by 175 days.

(21) Appl. No.: 16/348,514

(22) PCT Filed: Jun. 12, 2018

(86) PCT No.: PCT/CN2018/090871
§ 371 (c)(1),
(2) Date: May 9, 2019

(87) PCT Pub. No.: WO2019/184093
PCT Pub. Date: Oct. 3, 2019

(65) Prior Publication Data

US 2020/0331032 A1 Oct. 22, 2020

(30) Foreign Application Priority Data

Mar. 30, 2018 (CN) ..... 201810297211.4

(51) Int. Cl.
*B07C 5/10* (2006.01)
*B07C 5/342* (2006.01)
*B07C 5/36* (2006.01)

(52) U.S. Cl.
CPC ..... *B07C 5/3422* (2013.01); *B07C 5/362* (2013.01)

(58) Field of Classification Search
CPC ..... B07C 5/3422; B07C 5/362; B07C 5/342; B07C 5/10; B07C 5/34
See application file for complete search history.

(56) References Cited

U.S. PATENT DOCUMENTS 3,816,746 A * 6/1974 Gugliotta ..... G07C 3/14 250/223 R
4,823,396 A * 4/1989 Thompson ..... B07C 5/10 382/152

(Continued)

FOREIGN PATENT DOCUMENTS

CN 2898820 Y 5/2007
CN 201348501 Y 11/2009
CN 106216256 A 12/2016

*Primary Examiner* — Patrick H Mackey

(57) ABSTRACT

A system for detecting metal stamping part tapping defects, which comprises a product placing device, a detecting mechanism, a defective product sorting mechanism, a good product discharging mechanism, an analyzing mechanism and a Programmable Logic Control (PLC) system; the product placing device, the defective product sorting mechanism, and the good product discharging mechanism are connected to the PLC system respectively, the PLC system is configured to control the product placing device to place the metal stamping part in a detection position; the detecting mechanism is configured to acquire the tapping hole information of the metal stamping part tapping hole in the detection position.

6 Claims, 4 Drawing Sheets

(56) References Cited

U.S. PATENT DOCUMENTS

| | | | | |
|---|---|---|---|---|
| 6,594,529 | B1 * | 7/2003 | Boggs | G05B 19/0423 365/189.05 |
| 8,570,504 | B2 * | 10/2013 | Nygaard | G01N 21/88 356/237.1 |
| 9,731,328 | B2 * | 8/2017 | DeFillipi | B07C 5/342 |
| 2005/0011815 | A1 * | 1/2005 | Jeh | B07C 5/3422 209/576 |

* cited by examiner

SYSTEM AND METHOD FOR DETECTING METAL STAMPING PART TAPPING DEFECTS

TECHNICAL FIELD

The present application relates to the field of automatic production of metal stamping part, in particular to a system and method for detecting metal stamping part tapping defects.

BACKGROUND

In recent years, with the maturity of stamping technology in China, the specifications of metal stamping part are getting smaller and smaller, and the processing precision and speed are getting higher and higher, which makes it more difficult to detect the quality of metal stamping part in the later stage. The detection of the tapping hole after metal stamping part tapping is currently performed by manual visual inspection. The manual visual inspection requires the detection of the tapping of the metal stamping part. The inspectors are required to have excellent vision and endurance, and it takes a lot of human resources. Therefore, in the actual production process, the detection of the tapping hole after metal stamping part tapping is performed by manual sampling, which saves human resources, but cannot achieve comprehensive and effective quality control. There are serious hidden dangers in product quality. When metal stamping part tapping defects are not detected in time, the metal stamping parts flow to the product assembly line, which will lead to serious quality defects of the assembled products in the later stage. After the products are installed, the metal stamping parts cannot be detected. The assembly can be removed to re-detect the metal stamping parts after the product has quality problems, causing a lot of rework and waste of raw materials. The product quality problems that occur will result in serious safety accidents and economic losses, and even result in serious personal injury.

SUMMARY

The main object of the present application is to provide a system and method for detecting metal stamping part tapping defects for solving the technical problem that the prior art cannot automatically detect the tapping hole after the metal stamping part tapping.

In order to achieve the above object, the first embodiment of the present application provides a system for detecting metal stamping part tapping defects, wherein the detecting system comprises: a product placing device, a detecting mechanism, a defective product sorting mechanism, a good product discharging mechanism, an analyzing mechanism and a Programmable Logic Control (PLC) system;

the product placing device, the defective product sorting mechanism, and the good product discharging mechanism are connected to the PLC system, respectively, and the detecting mechanism is connected to the analyzing mechanism;

the PLC system is configured to control the operation of the product placing device, and the product placing device is configured to place the metal stamping part in a detection position;

the detecting mechanism is configured to acquire the tapping hole information of the metal stamping part tapping hole in the detection position;

the analyzing mechanism is configured to analyze the state of the tapping hole according to the tapping hole information, and feed back the state result of the tapping hole to the PLC system;

the PLC system is further configured to control the operation of the defective product sorting mechanism or the good product discharging mechanism according to the state result of the tapping hole; and the defective product sorting mechanism is configured to acquire defective products in the metal stamping part, and the good product discharging mechanism is configured to acquire good products in the metal stamping part.

The second embodiment of the present application provides a method for detecting metal stamping part tapping defects, wherein the detecting method comprises:

controlling, by the PLC system, the operation of the product placing device, and placing, by the product placing device, the metal stamping part in a detection position;

acquiring, by the detecting mechanism, the tapping hole information of the metal stamping part tapping hole in the detection position;

analyzing, by the analyzing mechanism, the state of the tapping hole according to the tapping hole information, and feeding back the state result of the tapping hole to the PLC system;

controlling, by the PLC system, the operation of the defective product sorting mechanism or the good product discharging mechanism according to the state result of the tapping hole; and acquiring, by the defective product sorting mechanism, defective products in the metal stamping part, and acquiring, by the good product discharging mechanism, good products in the metal stamping part.

According to the above technical solution provided by the present application, the present application provides a system for detecting metal stamping part tapping defects, wherein the system comprises: a product placing device, a detecting mechanism, a defective product sorting mechanism, a good product discharging mechanism, an analyzing mechanism and a PLC system. The product placing device, the defective product sorting mechanism, and the good product discharging mechanism are connected to the PLC system, respectively. The PLC system may control the operation of the product placing device, the defective product sorting mechanism, and the good product discharging mechanism. The PLC system controls the product placing device to place the metal stamping part in a detection position. The detecting mechanism may acquire the tapping hole information of the metal stamping part tapping hole in the detection position. Since the detecting mechanism is connected to the analyzing mechanism, the analyzing mechanism may acquire the tapping hole information. The analyzing mechanism identifies the state of the metal stamping part tapping hole according to the tapping hole information, and feeds back the state of the tapping hole to the PLC system. The PLC system controls the operation of the corresponding defective product sorting mechanism or the good product discharging mechanism according to the state of the tapping hole. The tapping hole after metal stamping part tapping is completed is automatically detected, improving the detection efficiency and accuracy compared to the manual detection of the prior art, and reducing the rising cost of the product after rework.

BRIEF DESCRIPTION OF THE DRAWINGS

In order to more clearly illustrate the embodiments of the present application or the technical solutions in the prior art, the drawings used in the embodiments or the description of the prior art will be briefly described below. Obviously, the drawings in the following description are only some embodiments of the present application, and those skilled in the art can obtain other drawings according to these drawings without any creative work.

DESCRIPTION OF THE EMBODIMENTS

The technical solutions in the embodiments of the present application will be clearly and completely described in conjunction with the drawings in the embodiments of the present application in order to make the objects, features and advantages of the present application more obvious and understandable. Obviously, the described embodiments are merely a part of the embodiments of the present application, rather than all of the embodiments. All other embodiments obtained by those skilled in the art based on the embodiments of the present application without any creative work fall within the scope of protection of the present application.

The technical problem that the prior art cannot automatically detect the tapping hole after the metal stamping part tapping exists. In order to solve the above technical problem, the present application provides a system for detecting metal stamping part tapping defects for automatically detecting the tapping hole after the metal stamping part tapping.

Figure 1:
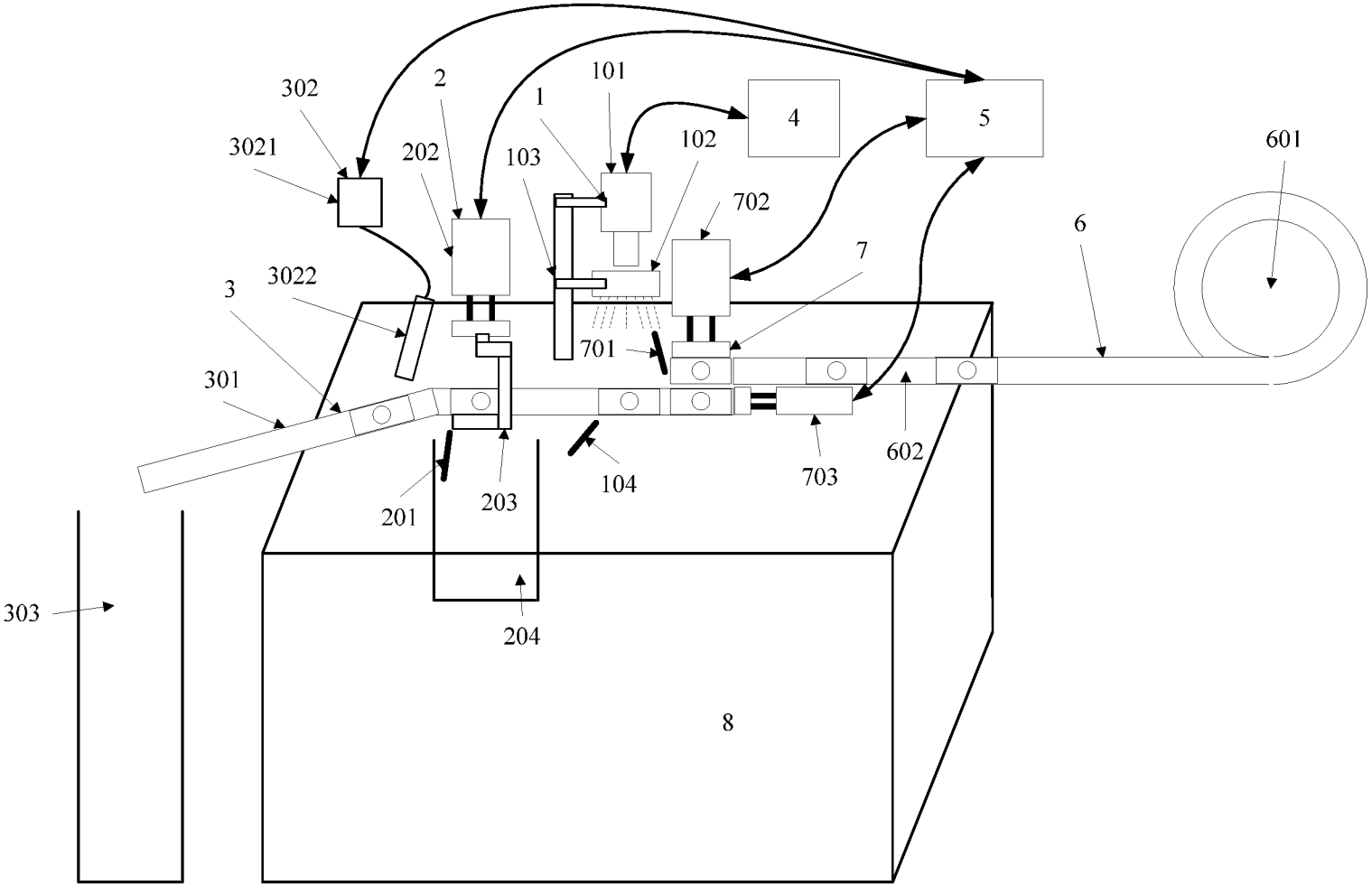
FIG. 1 is a schematic structural view of a system for detecting metal stamping part tapping defects according to the first embodiment of the present application.

Refer to FIG. 1, which is the schematic structural view of a system for detecting metal stamping part tapping defects according to the first embodiment of the present application. The detecting system comprises: a product placing device, a detecting mechanism 1, a defective product sorting mechanism 2, a good product discharging mechanism 3, an analyzing mechanism 4 and a Programmable Logic Control (PLC) system 5, wherein the product placing device, the defective product sorting mechanism 2, and the good product discharging mechanism 3 are connected to the PLC system 5, respectively. The detecting mechanism 1 is connected to the analyzing mechanism 4. The PLC system 5 is configured to control the operation of the product placing device, and the product placing device is configured to place the metal stamping part in a detection position. The detecting mechanism 1 is configured to acquire the tapping hole information of the metal stamping part tapping hole in the detection position. The analyzing mechanism 4 is configured to analyze the state of the tapping hole according to the tapping hole information, and feed back the state result of the tapping hole to the PLC system 5. The PLC system 5 is further configured to control the operation of the defective product sorting mechanism 2 or the good product discharging mechanism 3 according to the state result of the tapping hole. The defective product sorting mechanism 2 is configured to acquire defective products in the metal stamping part, and the good product discharging mechanism 3 is configured to acquire good products in the metal stamping part.

Specifically, the product placing device, the defective product sorting mechanism 2, and the good product discharging mechanism 3 are connected to the PLC system 5, respectively, so that the PLC system 5 can control the operation of the product placing device, the defective product sorting mechanism 2, and the good product discharging mechanism 3. The PLC system 5 controls the operation of the product placing device, and the product placing device places the metal stamping part in the detection position. The detection position is located in the detecting mechanism 1. After the metal stamping part is placed in the detection position, the detecting mechanism 1 acquires the tapping hole information of the metal stamping part tapping hole. The analyzing mechanism detects the state of the metal stamping part tapping hole according to the tapping hole information, and feeds back the state result of the detected tapping hole to the PLC system 5. The PLC system 5 controls the operation of one of the defective product sorting mechanism 2 and the good product discharging mechanism 3 according to the state result of the tapping hole which is fed back. When the PLC system 5 controls the operation of the defective product sorting mechanism 2, the defective product sorting mechanism 2 acquires the defective products in the metal stamping part. When the PLC system 5 controls the operation of the good product discharging mechanism 3, the good product discharging mechanism 3 acquires the good products in the metal stamping parts.

The tapping hole information acquired by the detecting mechanism 1 is an image of the metal stamping part tapping hole. The analyzing mechanism 4 analyzes the state of the tapping hole according to the image of the tapping hole. Since the analyzing mechanism 4 and the PLC system 5 are connected through a serial port, the analyzing mechanism 4 outputs the state result of the tapping hole through the serial port to the PLC system 5, so that the PLC system 5 controls the operation of the defective product sorting mechanism 2 or the good product discharging mechanism 3 according to the state result of the tapping hole.

According to the system for detecting metal stamping part tapping defects provided above, the present application provides a system for detecting metal stamping part tapping defects, wherein the system comprises: a product placing device, a detecting mechanism, a defective product sorting mechanism, a good product discharging mechanism, an analyzing mechanism and a PLC system. The product placing device, the defective product sorting mechanism, and the good product discharging mechanism are connected to the PLC system, respectively. The PLC system may control the operation of the product placing device, the defective product sorting mechanism, and the good product discharging mechanism. The PLC system controls the product placing device to place the metal stamping part in a detection position. The detecting mechanism may acquire the tapping hole information of the metal stamping part tapping hole in the detection position. Since the detecting mechanism is connected to the analyzing mechanism, the analyzing mechanism may acquire the tapping hole information. The analyzing mechanism identifies the state of the metal stamping part tapping hole according to the tapping hole information, and feeds back the state of the tapping hole to the PLC system. The PLC system controls the operation of the corresponding defective product sorting mechanism or the good product discharging mechanism according to the state of the tapping hole. The tapping hole after metal stamping part tapping is completed is automatically detected, improving the detection efficiency and accuracy compared to the manual detection of the prior art, and reducing the rising cost of the product after rework.

Further, as shown in FIG. 1, the product placing device comprises a loading mechanism 6 and a product pushing mechanism 7. The loading mechanism 6 comprises a vibrating plate 601 and a direct vibrator 602, and a portion of the vibrating disk 601 in a vibration feeding direction is connected to the direct vibrator 602. The vibrating plate 601 is configured to sequentially output the metal stamping part into the direct vibrator 602, and the direct vibrator 602 is configured to carry the metal stamping part to an inlet of the product pushing mechanism 7. The product pushing mechanism 7 comprises: a bit optical fiber 701, a pushing cylinder 702 and a feeding cylinder 703. The pushing cylinder 702 and the feeding cylinder 703 are connected to the PLC system 5, respectively. The bit optical fiber 701 is configured to sense the metal stamping part at the inlet, and output a photoelectrical signal to trigger the operation of the pushing cylinder 702 after the metal stamping part is sensed. The pushing cylinder 702 is configured to push the metal stamping part to a feeding position. The feeding cylinder 703 is configured to feed the metal stamping part in the feeding position to the detection position, so that the analyzing mechanism 4 analyzes the tapping hole information of the metal stamping part tapping hole.

Specifically, the metal stamping parts are sequentially arranged in the vibrating plate 601. The vibrating plate 601 sequentially transfers the metal stamping parts to the direct vibrator 602, and the direct vibrator 602 carries the metal stamping part to an inlet of the product pushing mechanism 7. The bit optical fiber 701 of the product pushing mechanism 7 senses that the metal stamping part reaches the pushing mechanism, and the bit optical fiber 701 outputs a photoelectrical signal to trigger the operation of the pushing cylinder 702. The pushing cylinder 702 pushes the metal stamping part at the inlet to the feeding position. The feeding cylinder 703 feeds the metal stamping part in the feeding position to the detection position, so that the analyzing mechanism 4 analyzes the tapping hole information of the metal stamping part tapping hole.

Further, as shown in FIG. 1, the detecting mechanism 1 comprises a detecting camera 101, a detecting light source 102, a detecting bracket 103, and a detecting optical fiber 104. The detecting camera 101 and the detecting light source 102 are fixedly connected to the detecting bracket 103, respectively, the detecting light source 102 is below the detecting camera 101, and the analyzing mechanism 4 is connected to the detecting camera 101. The detecting optical fiber 104 is configured to send a photographing signal to the detecting camera after the metal stamping part is sensed in the detection position, and the detecting camera 101 is configured to acquire a tapping image of the metal stamping part tapping hole. The analyzing mechanism 4 is configured to acquire the tapping image from the detecting camera 101, and identify the tapping image to obtain a tapping detection result of the metal stamping part.

Specifically, the detecting camera 101 and the detecting light source 102 are fixedly connected to the detecting bracket 103, respectively, thereby fixing the detecting camera 101 and the detecting light source 102 to the detecting bracket 103. The detecting light source 102 is below the detecting camera 101, and the detection position is below the detecting light source 102. When detecting the metal stamping part in the detection position, the detecting optical fiber 104 sends a signal to be photographed to the detecting camera 101, and the signal can cause the detecting camera to take a picture of the metal stamping part and obtain the tapping image of the metal stamping part tapping hole. The analyzing mechanism 4 is connected to the detecting camera 101, so that the analyzing mechanism 4 can acquire the tapping image of the metal stamping part tapping hole from the detecting camera 101. After acquiring the tapping image, the analyzing mechanism 4 identifies the tapping image to obtain a tapping detection result of the metal stamping part.

It should be noted that the image illustrating the metal stamping part tapping hole is the acquired tapping image.

Further, the detecting light source 102 is an annular light source. The annular light source is soft and concentrated, which can effectively avoid interference of external light on the product and improve the precision of the tapping detection result of the metal stamping part.

Further, the analyzing mechanism 4 is a Charge Coupled Device (CCD) detecting mechanism, and the CCD detecting mechanism is configured to identify the acquired tapping image and output corresponding defective product signals or good product signals according to the identified tapping detection result.

Specifically, a CCD detecting software is provided in the CCD detecting mechanism. The CCD detecting software acquires a tapping image, and identifies the tapping image to determine whether there is a tapping defect in the metal stamping part. When there is a tapping defect, the CCD detecting software outputs a defective product signal, and the metal stamping part is a defective product; when there is no tapping defect, the CCD detecting software outputs a good product signal, and the metal stamping part is a good product.

It should be noted that both the good product signal and the defective product signal described above are two different transmittable electrical signals indicating the state of detecting the tapping hole. When there is a tapping defect as the tapping detection result of the metal stamping part, a defective product signal is output. When there is no tapping defect as the tapping detection result of the metal stamping part, a good product signal is output.

Further, as shown in FIG. 1, the detecting system further comprises a cabinet 8 in which each of the loading mechanism 6, the product pushing mechanism 7, the detecting mechanism 1, the defective product sorting mechanism 2, and the good product discharging mechanism 3 is provided, ensuring the integrity of the detecting system.

Further, as shown in FIG. 1, the defective product sorting mechanism 2 comprises: a sensing optical fiber 201, a defective product processing cylinder 202, and a mechanical finger 203. The mechanical finger 203 is connected to the defective product processing cylinder 202, and the sensing optical fiber 201 is configured to sense the detected metal stamping part. The defective product processing cylinder 202 is configured to drive the mechanical finger 203 to move when receiving a defective product signal, and the mechanical finger 203 is configured to bring the defective products in the metal stamping part to the defective product area.

Specifically, the PLC system 5 receives the defective product signal. After the sensing optical fiber 201 senses the detected metal stamping part, the PLC system 5 controls the operation of the defective product processing cylinder 202. The operation of the defective product processing cylinder 202 drives the mechanical finger 203 to move to the operating position. The defective product processing cylinder 202 blows the metal stamping part into the mechanical finger 203, and the mechanical finger 203 brings the metal stamping part to the defective product area to complete the screening of defective products.

Further, as shown in FIG. 1, the good product discharging mechanism 3 comprises: a good product discharging guide rail 301, an air blowing device 302, and a receiving box 303. The good product discharging guide rail 301 is obliquely mounted on the cabinet 8, and the receiving box 303 is below the good product discharging guide rail 301. The good product discharging guide rail 301 is used as the track for discharging the good products in the metal stamping part, and the air blowing device 302 is configured to blow the good products to the receiving box 303.

Specifically, the PLC system 5 receives the good product signal. After the sensing optical fiber 201 senses the detected metal stamping part, the PLC system 5 controls the operation of the air blowing device 302. The air blowing device 302 blows the metal stamping part to the good product discharging guide rail 301. The metal stamping part moves on the inclined good product discharging guide rail 301 under the assistance of the air blowing device, and finally flows into the receiving box 303 to complete the discharging of the good products.

Further, the air blowing device 302 comprises a solenoid valve 3021 and an air pipe 3022. The blowing device 302 is used to speed up the processing speed of the good products and improve the overall detection efficiency.

It should be noted that the bit optical fiber 701, the detecting optical fiber 104 and the sensing optical fiber 201 in the method all trigger the operation of other mechanisms by outputting a photoelectrical signal.

It can be seen from the above detecting system that using the detecting system of the present application, the detection on the tapping defects of good products in the metal stamping parts is completed by a plurality of structures together. The detecting system is smooth in operation, automatic in detection in the whole process, high in degree of automation, simple in structure, and easy to achieve.

The second embodiment of the present application provides a method for detecting metal stamping part tapping defects, which is applied to the system for detecting metal stamping part tapping defects provided by the first embodiment.

Figure 2:
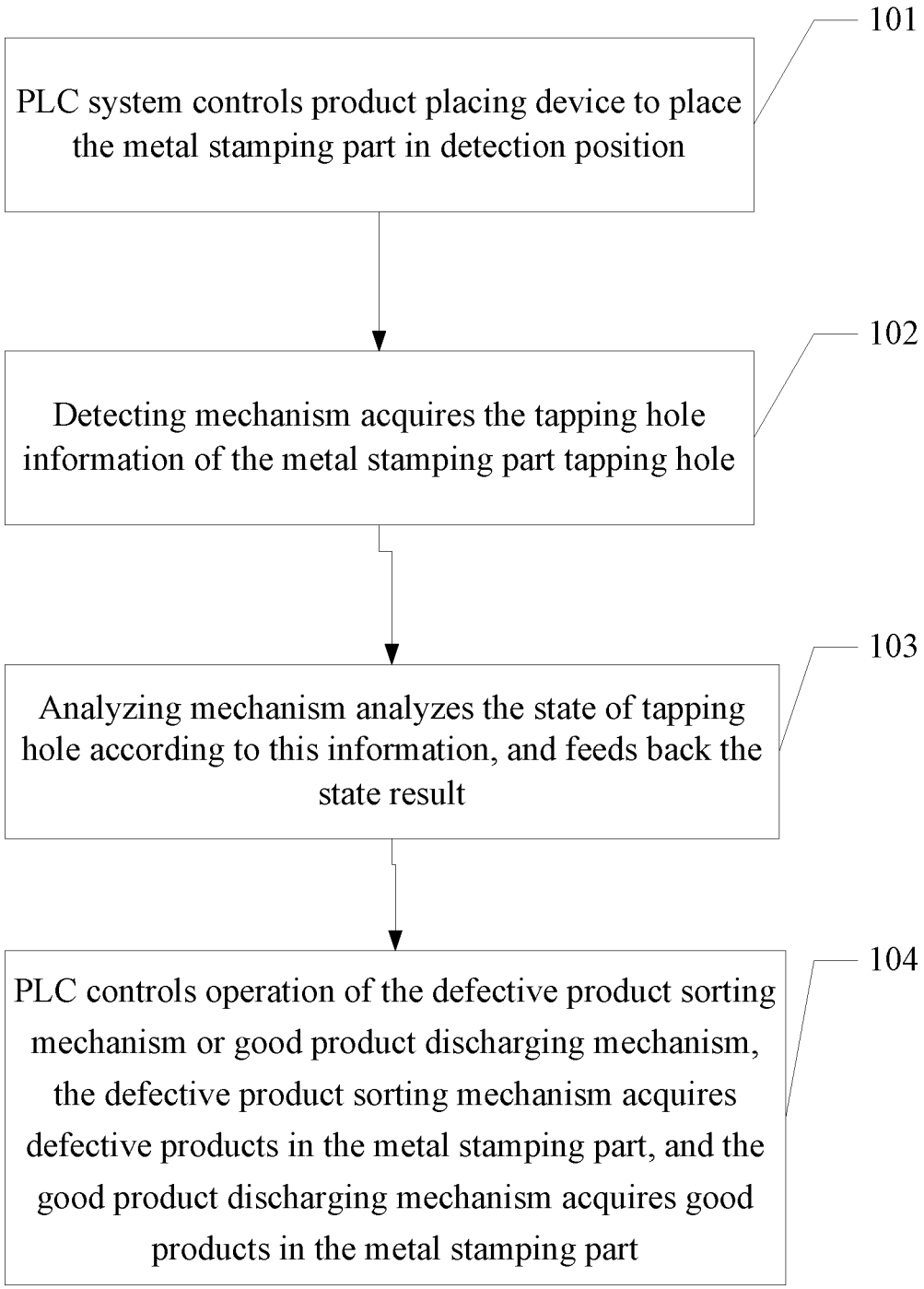
FIG. 2 is a schematic flow chart of a method for detecting metal stamping part tapping defects according to the second embodiment of the present application.

Refer to FIG. 2, which is a schematic flow chart of a method for detecting metal stamping part tapping defects according to the second embodiment of the present application. The detecting method is used in the detecting system of the first embodiment, and the detecting method comprises steps 101 to 105.

At step 101, the PLC system controls the operation of the product placing device, and the product placing device places the metal stamping part in a detection position.

At step 102, the detecting mechanism acquires the tapping hole information of the metal stamping part tapping hole in the detection position.

At step 103, the analyzing mechanism analyzes the state of the tapping hole according to the tapping hole information, and feeds back the state result of the tapping hole to the PLC system.

At step 104, the PLC system controls the operation of the defective product sorting mechanism or the good product discharging mechanism according to the state result of the tapping hole, the defective product sorting mechanism acquires defective products in the metal stamping part, and the good product discharging mechanism acquires good products in the metal stamping part.

Specifically, the PLC system can control the operation of the product placing device, the defective product sorting mechanism, and the good product discharging mechanism. The PLC system controls the operation of the product placing device, and the product placing device places the metal stamping part in the detection position. The detection position is located in the detecting mechanism. After the metal stamping part is placed in the detection position, the detecting mechanism acquires the tapping hole information of the metal stamping part tapping hole. The analyzing mechanism analyzes the state of the metal stamping part tapping hole according to the tapping hole information, and feeds back the state result of the analyzed tapping hole to the PLC system. The PLC system controls the operation of one of the defective product sorting mechanism and the good product discharging mechanism according to the state result of the tapping hole which is fed back. When the PLC system controls the operation of the defective product sorting mechanism, the defective product sorting mechanism acquires the defective products in the metal stamping part. When the PLC system controls the operation of the good product discharging mechanism, the good product discharging mechanism acquires the good products in the metal stamping parts.

The tapping hole information acquired by the detecting mechanism is an image of the metal stamping part tapping hole. The analyzing mechanism analyzes the state of the tapping hole according to the image of the tapping hole and then feeds back the state result to the PLC system for further operation.

According to the method for detecting metal stamping part tapping defects provided above, in the method, the PLC system controls the product placing device to place the metal stamping part in a detection position. The detecting mechanism may acquire the tapping hole information of the metal stamping part tapping hole in the detection position. The analyzing mechanism identifies the state of the metal stamping part tapping hole according to the tapping hole information, and feeds back the state of the tapping hole to the PLC system. The PLC system controls the operation of the corresponding defective product sorting mechanism or the good product discharging mechanism according to the state of the tapping hole. The tapping hole after metal stamping part tapping is completed is automatically detected, improving the detection efficiency and accuracy compared to the manual detection of the prior art, and reducing the rising cost of the product after rework.

Figure 3:
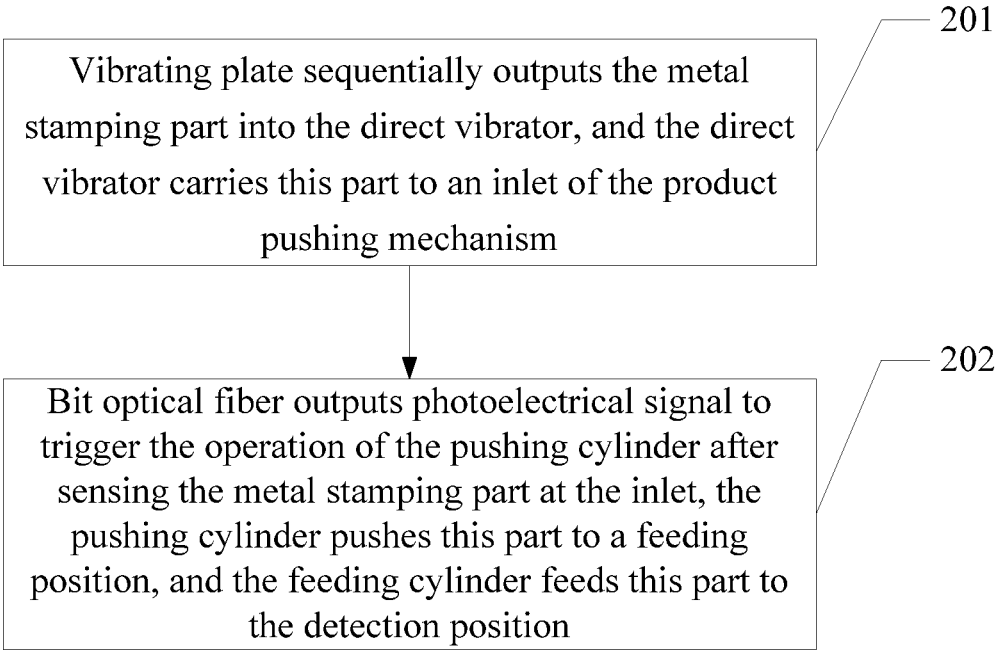
FIG. 3 is a schematic flow chart of the refining step of step 101.

Further, as shown in FIG. 3, FIG. 3 is a schematic flow chart of the refining step of step 101. The refining step of step 101 comprises steps 201 to 202.

At step 201, the vibrating plate sequentially outputs the metal stamping part into the direct vibrator, and the direct vibrator carries the metal stamping part to an inlet of the product pushing mechanism.

At step 202, the bit optical fiber in the product pushing mechanism outputs a photoelectrical signal to trigger the operation of the pushing cylinder after sensing the metal stamping part at the inlet, the pushing cylinder pushes the metal stamping part to a feeding position, and the feeding cylinder feeds the metal stamping part in the feeding position to the detection position.

Specifically, the metal stamping parts are sequentially arranged in the vibrating plate. The vibrating plate sequentially transfers the metal stamping part to the direct vibrator, and the direct vibrator carries the metal stamping part to an inlet of the product pushing mechanism. The bit optical fiber in the product pushing mechanism senses that the metal stamping part reaches the pushing mechanism, and the bit optical fiber outputs a photoelectrical signal to trigger the operation of the pushing cylinder. The pushing cylinder pushes the metal stamping part at the inlet to the feeding position. The feeding cylinder feeds the metal stamping part in the feeding position to the detection position, so that the analyzing mechanism analyzes the tapping hole information of the metal stamping part tapping hole.

Figure 4:
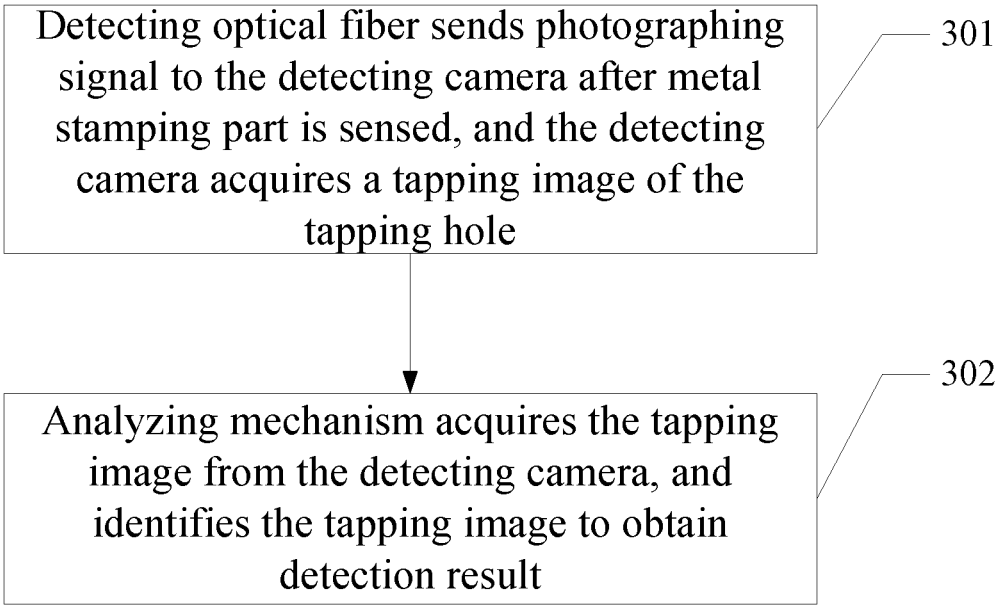
FIG. 4 is a schematic flow chart of the refining step of step 102.

Further, as shown in FIG. 4, FIG. 4 is a schematic flow chart of the refining step of step 102. The refining step of step 102 comprises steps 301 to 302.

At step 301, the detecting optical fiber sends a photographing signal to the detecting camera after the metal stamping part is sensed in the detection position, and the detecting camera acquires a tapping image of the metal stamping part tapping hole.

At step 302, the analyzing mechanism acquires the tapping image from the detecting camera, and identifies the tapping image to obtain a tapping detection result of the metal stamping part.

Specifically, when detecting the metal stamping part in the detection position, the detecting optical fiber sends a signal to be photographed to the detecting camera, and the signal can cause the detecting camera to take a picture of the metal stamping part and obtain the tapping image of the metal stamping part tapping hole. The analyzing mechanism can acquire the tapping image of the metal stamping part tapping hole from the detecting camera. After acquiring the tapping image, the analyzing mechanism identifies the tapping image to obtain a tapping detection result of the metal stamping part.

The CCD detecting mechanism mainly detects the CCD detecting software. The CCD detecting software acquires a tapping image, and identifies the tapping image to determine whether there is a tapping defect in the metal stamping part. When there is a tapping defect, the CCD detecting software outputs a defective product signal, and the metal stamping part is a defective product; when there is no tapping defect, the CCD detecting software outputs a good product signal, and the metal stamping part is a good product.

It should be noted that both the good product signal and the defective product signal described above are two different transmittable electrical signals indicating the state of detecting the tapping hole. When there is a tapping defect as the tapping detection result of the metal stamping part, a defective product signal is output. When there is no tapping defect as the tapping detection result of the metal stamping part, a good product signal is output.

It should also be noted that the above describes that the image of the metal stamping part tapping hole is the acquired tapping image.

Figure 5:
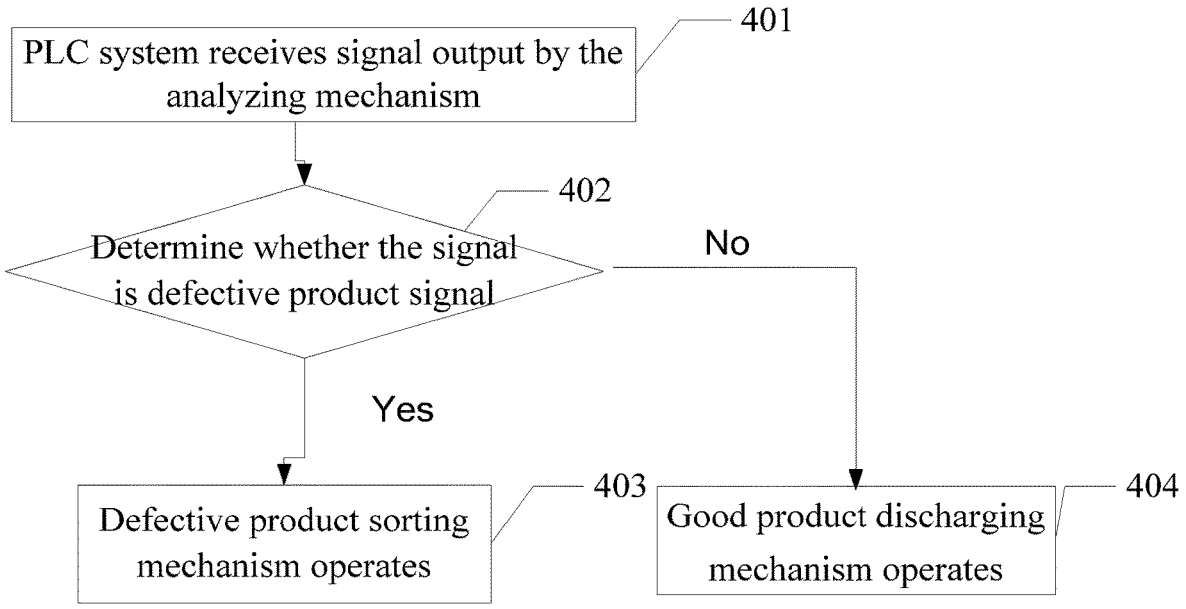
FIG. 5 is a schematic flow chart of the refining step of step 104.

Further, refer to FIG. 5, which is a schematic flow chart of the refining step of step 104. The refining step of step 104 comprises steps 401 to 404.

At step 401, the PLC system receives a signal output by the analyzing mechanism.

At step 402, it is determined whether the signal is a defective product signal.

At step 403, if the signal is a defective product signal, the defective product sorting mechanism operates.

At step 404, if the signal is not a defective product signal, the good product discharging mechanism operates.

Specifically, the analyzing mechanism outputs two different electrical signals after analyzing the tapping image. The PLC system receives two sets of electrical signals output by the analyzing mechanism. If the electrical signal is a defective product signal, the PLC system controls the operation of the defective product sorting mechanism, and the defective product sorting mechanism screens out the defective products of the metal stamping parts. If the electrical signal is a good product signal, the PLC system controls the operation of the good product discharging mechanism, and the good product discharging mechanism operates to collect the good products of the metal stamping parts.

The PLC system controls the operation of the defective product sorting mechanism or the good product discharging mechanism in such a manner that after the sensing optical fiber senses the metal stamping part, the sensing optical fiber outputs a photoelectric signal to trigger the PLC system to control the operation of the defective product sorting mechanism or the good product discharging mechanism.

The specific steps of the operation of the defective product sorting mechanism are as follows: the defective product processing cylinder drives the mechanical finger to move, and the mechanical finger brings the defective products in the metal stamping part to the defective product area. The operation of the good product discharging mechanism is as follows: the air blowing device blows the metal stamping parts of the good products into the good product discharging guide rail, the good products of the metal stamping parts roll in the inclined good product discharging guide rail, and finally enter the receiving box to complete collecting metal stamping parts of good products.

It should be noted that, in the method, each of the bit optical fiber, the detecting optical fiber and the sensing optical fiber triggers the operation of other mechanisms by outputting a photoelectrical signal.

It should be noted that, for the sake of brevity, each of the above method embodiments is described as a combination of a series of actions, but those skilled in the art should understand that the present application is not limited by the described action sequence because certain steps may be performed in other sequences or concurrently in accordance with the present application. Secondly, those skilled in the art should also understand that the embodiments described in the specification are all preferred embodiments, and the actions and modules involved are not necessarily required by the present application.

In the above embodiments, the descriptions of the various embodiments are different, and the details that are not detailed in a certain embodiment can refer to the related descriptions of other embodiments.

The above is a description of a system and method for detecting metal stamping part tapping defects provided by the present application. For those skilled in the art, in accordance with the idea of the embodiment of the present application, the specific embodiment and the application range may be changed. In conclusion, the content of this specification is not to be construed as limiting the present application.

What is claimed is:

1. A system for detecting metal stamping part tapping defects, wherein the system comprises a product placing device, a detecting mechanism, a defective product sorting mechanism, a good product discharging mechanism, an analyzing mechanism and a programmable logic control system;

the product placing device, the defective product sorting mechanism and the good product discharging mechanism are connected to the programmable logic control system, respectively, and the detecting mechanism is connected to the analyzing mechanism;

the programmable logic control system is configured to control the operation of the product placing device, and the product placing device is configured to place the metal stamping part in a detection position;

the detecting mechanism is configured to acquire a tapping hole information of the metal stamping part tapping hole in the detection position;

the analyzing mechanism is configured to analyze a state of the tapping hole according to the tapping hole information, and feed back a state result of the tapping hole to the programmable logic control system;

the programmable logic control system is further configured to control the operation of the defective product sorting mechanism or the good product discharging mechanism according to the state result of the tapping hole; and the defective product sorting mechanism is configured to acquire defective products in metal stamping parts, and the good product discharging mechanism is configured to acquire good products in the metal stamping part;

wherein the product placing device comprises:

a loading mechanism and a product pushing mechanism;

the loading mechanism comprises a vibrating plate and a direct vibrator, and a portion of a vibrating disk in a vibration feeding direction is connected to the direct vibrator;

the vibrating plate is configured to sequentially output the metal stamping part into the direct vibrator, and the direct vibrator is configured to carry the metal stamping part to an inlet of the product pushing mechanism;

the product pushing mechanism comprises a bit optical fiber, a pushing cylinder and a feeding cylinder, wherein the pushing cylinder and the feeding cylinder are connected to the programmable logic control system, respectively; and the bit optical fiber is configured to sense the metal stamping part at the inlet, and output a photoelectrical signal to trigger the operation of the pushing cylinder after the metal stamping part is sensed, the pushing cylinder is configured to push the metal stamping part to a feeding position, and the feeding cylinder is configured to feed the metal stamping part in the feeding position to the detection position.

2. The system of claim 1, wherein the detecting mechanism comprises a detecting camera, a detecting light source, a detecting bracket and a detecting optical fiber;

the detecting light source is an annular light source, the detecting camera and the detecting light source are fixedly connected to the detecting bracket, respectively, the detecting light source is arranged below the detecting camera, and the analyzing mechanism is connected to the detecting camera;

the detecting optical fiber is configured to send a photographing signal to the detecting camera after the metal stamping part is sensed in the detection position, and the detecting camera is configured to acquire a tapping image of the metal stamping part tapping hole; and the analyzing mechanism is configured to acquire the tapping image from the detecting camera, and identify the tapping image to obtain a tapping detection result of the metal stamping part.

3. The system of claim 1, wherein the analyzing mechanism is a charge coupled device detecting mechanism, and the charge coupled device detecting mechanism is configured to identify the tapping image and output corresponding defective product signals or good product signals according to the identified tapping detection result.

4. The system of claim 1, wherein the system further comprises a cabinet in which the loading mechanism, the product pushing mechanism, the detecting mechanism, the defective product sorting mechanism and the good product discharging mechanisms are provided.

5. The system of claim 4, wherein the defective product sorting mechanism comprises a sensing optical fiber, a defective product processing cylinder and a mechanical finger;

the mechanical finger is connected to the defective product processing cylinder, and the sensing optical fiber is configured to sense the detected metal stamping part; and the defective product processing cylinder is configured to drive the mechanical finger to move when receiving a defective product signal, and the mechanical finger is configured to bring the defective products in the metal stamping part to the defective product area.

6. The system of claim 5, wherein the good product discharging mechanism comprises a good product discharging guide rail, an air blowing device and a receiving box;

the good product discharging guide rail is obliquely mounted on the cabinet, and the receiving box is arranged below the good product discharging guide rail;

the good product discharging guide rail is used as the track for discharging the good products in the metal stamping part, and the air blowing device is configured to blow the good products to the receiving box; and the air blowing device comprises a solenoid valve and an air pipe.

* * * * *